US005383614A

United States Patent [19]

Panning

[11] Patent Number: 5,383,614

[45] Date of Patent: Jan. 24, 1995

[54] AIR SEAL FOR THE PRODUCT DISCHARGE OF A CYCLONE SEPARATOR OR SIMILAR DEVICE

[76] Inventor: Martin H. Panning, P.O. Box 399, Thiensville, Wis. 53092

[21] Appl. No.: 135,263

[22] Filed: Oct. 12, 1993

[51] Int. Cl.[6] ..... B02C 23/08

[52] U.S. Cl. ..... 241/79.1; 100/233; 222/491; 222/564

[58] Field of Search ..... 241/79, 79.1; 100/229 R, 229 A, 233; 222/64, 491, 504, 517, 556, 564

[56] References Cited

U.S. PATENT DOCUMENTS

| | | | |
|---|---|---|---|
| 2,252,608 | 8/1941 | Ballert | 214/67 |
| 2,548,022 | 4/1951 | Hirsch | 222/196 |
| 2,676,668 | 4/1954 | Lindsay | 183/4.2 |
| 3,220,557 | 11/1965 | Laverne | 214/83.3 |
| 3,231,146 | 1/1966 | Troy | 222/233 |
| 3,539,061 | 11/1970 | Burgess | 214/83.3 |
| 3,626,486 | 12/1971 | Bugbee et al. | 210/405 |
| 3,680,478 | 8/1972 | Beachner, Jr. et al. | 100/229 |
| 4,235,665 | 11/1980 | Reinhall et al. | 241/79.1 X |
| 5,050,770 | 9/1991 | Smiley | 221/1 |
| 5,184,780 | 2/1993 | Wiens | 241/79.1 X |

*Primary Examiner*—Timothy V. Eley
*Attorney, Agent, or Firm*—Michael, Best & Friedrich

[57] ABSTRACT

An apparatus for providing an air seal for a device discharging a compressible product, the apparatus including a generally horizontal conduit having an upwardly opening inlet and an outlet spaced from the inlet, a packer blade mounted in the conduit for pivotal movement about a generally vertical axis, the packer blade having a stroke path extending beneath the inlet, a motor connected to the packer blade to cause reciprocating pivotal movement of the packer blade about the axis so that product entering the conduit via the inlet is swept by the packer blade toward the outlet, and a discharge resistor which is located in the conduit between the packer blade and the outlet, which resists the flow of product through the conduit toward the outlet, and which permits compressed product to flow out of the conduit via the outlet, such that the packer blade and the discharge resistor cause uniform compression of the product between the packer blade and the discharge resistor so as to form a plug of product that substantially prevents air flow through the conduit in either direction.

19 Claims, 2 Drawing Sheets

AIR SEAL FOR THE PRODUCT DISCHARGE OF A CYCLONE SEPARATOR OR SIMILAR DEVICE

BACKGROUND OF THE INVENTION

The invention relates generally to the handling of product exiting a device such as a cyclone separator, and more specifically to a cyclone separator having a sealed valve connected to the bottom outlet of the cyclone separator.

It is generally known to utilize a cyclone separator to handle fibrous or other compressible products. The commonly known cyclone separator has an inlet, a top outlet and a bottom outlet. A product is air conveyed to the cyclone separator via the inlet where it is centrifugally separated from the conveying air so that the solid product exits at the bottom outlet while the air exits from the top outlet. Product exiting via the bottom outlet is received in a baler or other receiving receptacle.

If air is allowed to escape through the bottom outlet with the product, some of the air/product mixture may not flow into the receiving receptacle. Typically, the result is that material escapes from the system in the form of dust and debris that can create environmental or health risks. Prior attempts to solve this problem provided a sealed baler at the bottom outlet of the cyclone separator to prevent the air from escaping. However, these balers are very expensive because of the close tolerances required to seal the interfaces between the moving parts and because of the constant maintenance which naturally follows from these close tolerances.

SUMMARY OF THE INVENTION

Accordingly, it is an advantage to provide a cost effective apparatus that is connected to the bottom outlet of a cyclone separator to seal the outlet (i.e., to prevent the flow of air in either direction), to prevent the escape of product into the environment where the product could create an environmental hazard or health risk, and to accommodate a continuous flow of product from the bottom outlet of the separator.

The invention provides an oscillating blade valve for sealing the product outlet of a cyclone separator discharging a compressible product. The oscillating blade valve includes a generally horizontal conduit having a longitudinal axis, an upwardly opening inlet, and an outlet spaced from the inlet. The inlet is connected to the separator outlet. A generally vertical drive shaft is mounted in the conduit directly beneath the inlet, preferably adjacent the downstream side of the inlet. A motor is connected to the lower end of the drive shaft, beneath the conduit, to cause reciprocating pivotal movement of the drive shaft over a range of between 180° and 270° about the axis.

The oscillating blade valve also includes a vertically extending packer blade mounted on the drive shaft, within the conduit, for pivotal movement with the drive shaft. The packer blade has a stroke path that extends beneath the inlet and that is bisected by a generally vertical plane including the longitudinal axis of the conduit. Product entering the conduit via the inlet is swept by the packer blade toward the outlet.

The oscillating blade valve also includes a discharge resistor in the conduit between the packer blade and the outlet. The discharge resistor is preferably a gate pivotally mounted in the conduit. The gate resists the flow of product through the conduit toward the outlet, and the gate and the packer blade cause substantially uniform compression of the product between the packer blade and the gate. The gate pivots to permit compressed product to flow out of the conduit via the outlet when the pressure of the product in the conduit overcomes the resistance of the gate. The gate prevents product from exiting the conduit before the product is sufficiently compressed.

The oscillating blade valve also includes a stepped portion in the conduit between the packer blade and the outlet to form a back-flow dam that resists the back-flow of product, i.e., flow from the outlet toward the packer blade. As an alternative to the back-flow dam, one or more spring loaded retainer dogs can be mounted in the conduit. The retainer dogs would allow the entire conduit to be made of conduit sections having the same cross-sectional size.

A typical hydraulic, horizontal baler for paper and cardboard produces bales approximately 2.5 ft. wide, 3 ft. high by 6 ft. long, or in the 45 cu. ft. range. These bales may weigh from 900 to over 1200 lbs. depending on the product and the ram pressure. The baler ram typically has a face of approximately 2.5 ft. ×3 ft. and a charging stroke of 3 or more feet. Thus, the volume compressed per stroke is on the order of 22.5 cu. ft. Air conveyed paper products may drop into the charging chamber as light as 2 lbs/cu. ft. At that density, approximately 20 strokes are required to make a 900 lb. bale. Stroking speeds of balers range from about 3 to perhaps 8 strokes per minute, depending upon capacity and power. Also, maximum ram face pressures generally fall in the 40–70 PSI range. Therefore, with modest power input to the oscillating blade valve, the product could be precompressed to the 6–8 lbs/cu. ft. range thus making it possible to use less costly, slower stroking speed balers for the same finished bale tonnage output. The power used by the oscillating blade valve would likely be saved in the baler.

A principal feature of the invention is the provision of an apparatus for sealing the bottom outlet of a cyclone separator to prevent the leakage of air and product into the environment before the product is deposited in a baler or other receiving receptacle.

Another feature of the invention is the provision of an apparatus that does not require close tolerances, that has a large volumetric capacity and that operates at a relatively slow speed.

Another feature of the invention is the provision of an apparatus that compresses the product exiting from the cyclone separator and forces the compressed product into a baler feed hopper or other receptacle.

Another feature of the invention is the provision of an apparatus that compresses the product exiting the cyclone separator into a densified plug, allows only unidirectional flow of the densified plug through the apparatus, and prevents the flow of air in either direction.

Another feature of the invention is the provision of an apparatus having a packer blade that preferably rotates through a stroke path of 240° to provide substantially uniform compression of the product.

Another feature of the invention is the provision of an apparatus having a discharge resistor to uniformly compress the product to form the densified product plug.

Other features and advantages of the invention will become apparent to those skilled in the art upon review of the following detailed description, claims and drawings.

Figure 1:
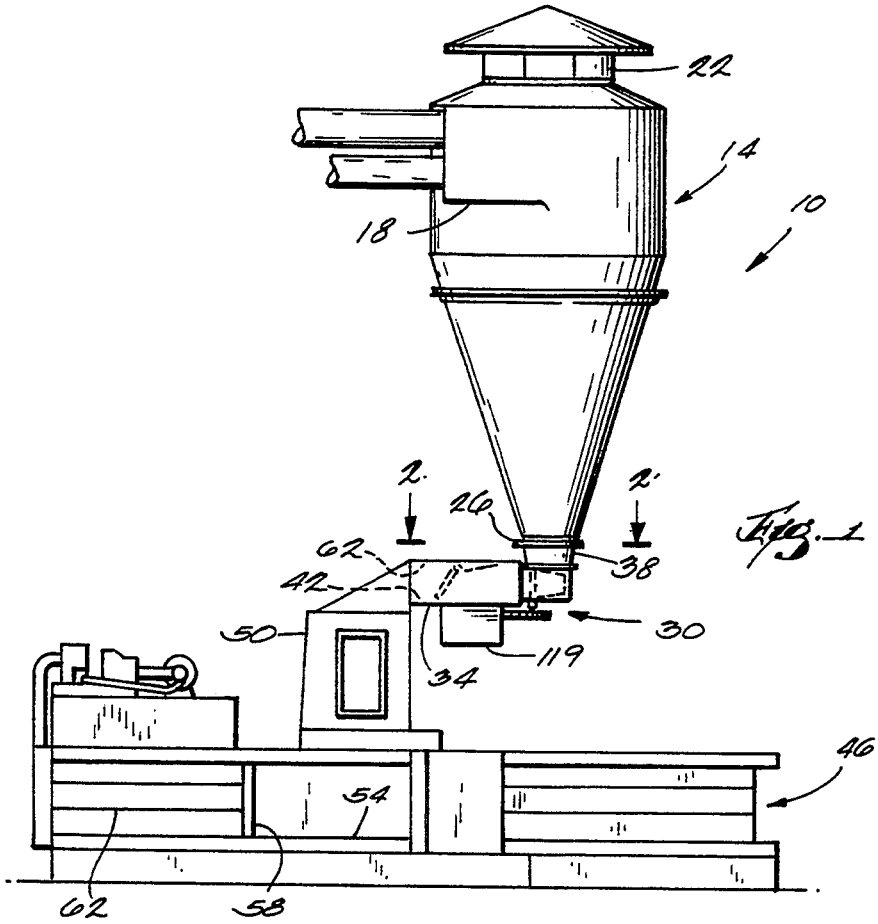
FIG. 1 is a side elevational view of a system including an apparatus embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose description and should not be regarded as limiting.

DESCRIPTION OF THE PREFERRED EMBODIMENT

Shown in FIG. 1 of the drawings is a system 10 for shredding and compacting a compressible product. The system 10 includes a cyclone separator 14. The product is mixed with air so that the product can be air conveyed to the cyclone separator 14. The cyclone separator 14 has an inlet 18 for receiving the air/product mixture. The separator 14 also includes an air outlet 22 adjacent the top of the separator 14 and a bottom outlet 26 adjacent the bottom of the separator 14 for expelling product from the separator 14.

The system 10 also includes an air seal preferably in the form of an oscillating blade valve 30. The valve 30 is connected to the bottom outlet 26 of the cyclone separator 14. As will be explained in greater detail below, the valve 30 includes a conduit 34 having an upwardly opening inlet 38 connected to the bottom outlet 26 and having an outlet 42 spaced from the inlet 38.

The system 10 also includes a baler 46 connected to the valve outlet 42 by a baler feed hopper 50. The feed hopper 50 communicates with a chamber 54 in the baler 46. One wall of the chamber 54 is a piston 58 connected to a power actuated ram 62. The piston and ram assembly are motor driven to compress product in the baler chamber 54. The baled product is then removed from the baler 46 in a manner commonly known in the art. The particular features of the cyclone separator 14 and the baler 46 form no part of the invention and accordingly will not be described in greater detail.

Figure 2:
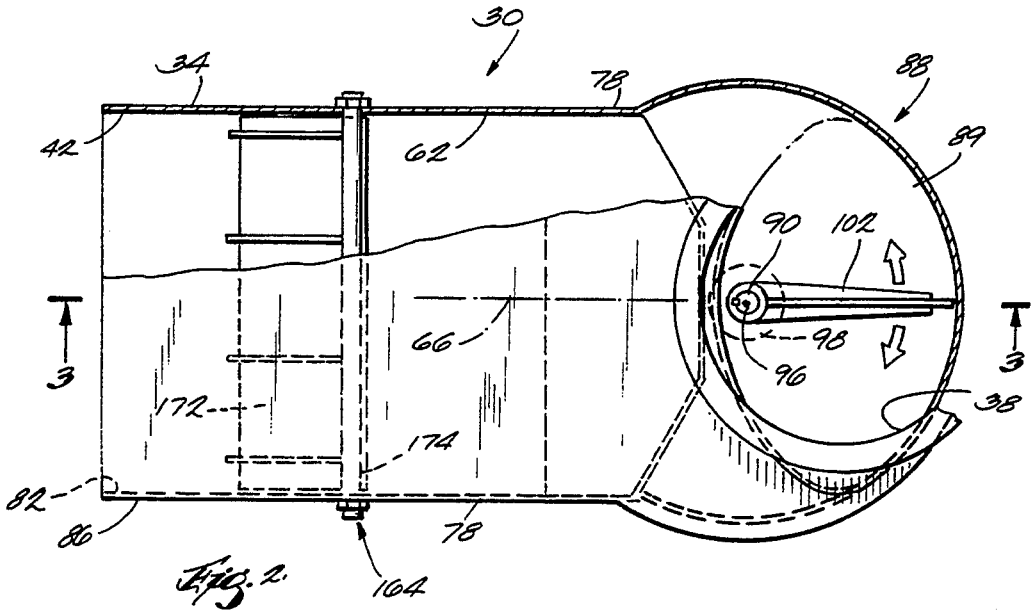
FIG. 2 a view, partially cut away, taken along line 2—2 in FIG. 1.
Figure 3:
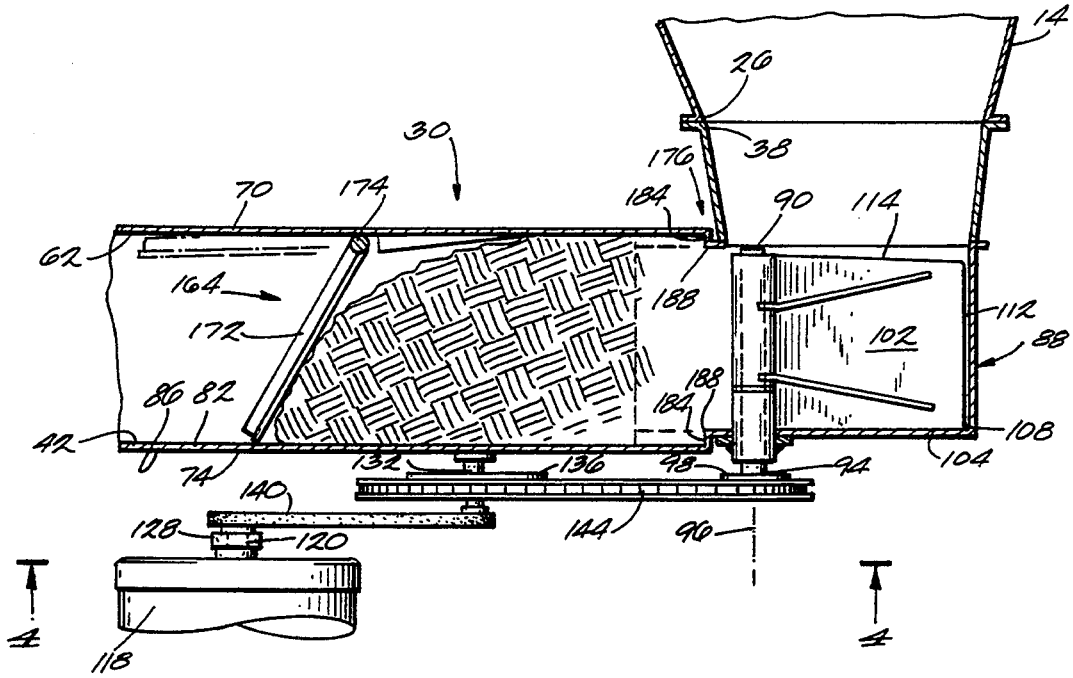
FIG. 3 is a view taken generally along line 3—3 in FIG. 2.

Referring specifically to FIGS. 2 and 3, the valve conduit 34 defines a passage 62 extending between the inlet 38 and the outlet 42. The conduit 34 has a longitudinal axis 66 (FIG. 2), such that the vertical plane including the axis 66 bisects the conduit 34. The conduit 34 is generally rectangular in cross-section and has generally horizontal top and bottom walls 70 and 74 (FIG. 3), and generally vertical side walls 78 (FIG. 2) connecting the top wall 70 to the bottom wall 74 to form the conduit. The conduit has an inner surface 82 and an outer surface 86. The conduit 34 also includes an end portion 88 directly beneath the inlet 38. The end portion 88 has a sidewall that is generally circular in horizontal cross-section (FIG. 2) and that defines a packing chamber 89. While the drawings illustrate the conduit 34 as being generally horizontal, it is possible to orient the conduit 34 at an angle relative to horizontal as need requires.

The valve 30 includes a drive shaft 90 which has a lower end 94. The drive shaft 90 is mounted in the bottom wall 74 of the conduit 34 for pivotal movement about an axis 96 and is directly beneath the inlet 38, adjacent the downstream side of the inlet 38, so that the lower end 94 of the drive shaft 90 extends through the bottom wall 74. A sprocket 98 is mounted on the lower end 94 of the drive shaft 90 for pivotal movement with the drive shaft 90.

Figure 4:
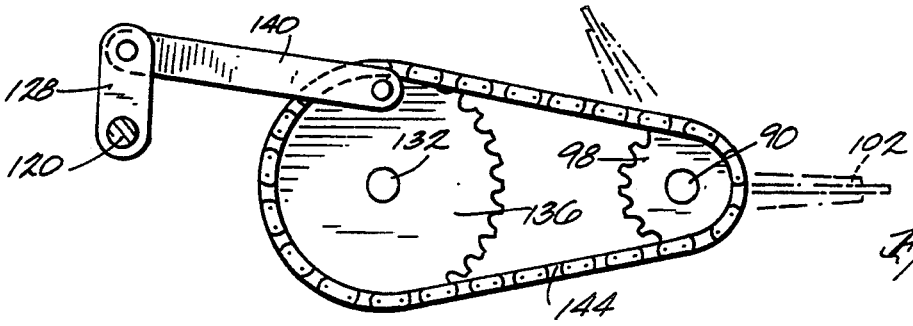
FIG. 4 is a view taken along line 4—4 in FIG. 3.

The valve 30 includes a generally vertical packer blade 102. The packer blade 102 is mounted on the drive shaft 90 for pivotal movement with the drive shaft 90 about the axis 96. The packer blade 102 is mounted so that, as it sweeps through the packing chamber 89, the packer blade 102 defines a stroke path that extends directly beneath the inlet 38. As shown best in FIGS. 2 and 3, the packer blade 102 extends radially outward from the axis 96 and includes a lower edge 104 having an end 108 spaced from the axis 96. An outer edge 112 extends upward from the end 108 so that the lower edge 104 is complimentary with the inner surface 82 of the bottom wall 74 of the conduit 34 and so that the outer edge 112 is complimentary with the inner surface 82 of the side wall of the conduit end portion 88. Thus the stroke path of the packer blade 102 sweeps throughout the entire packing chamber 89 to contact any product entering the conduit 34 via the inlet 38. The packer blade also includes a top edge 114. Preferably, there is sufficient clearance between the top edge of the packer blade 102 and the inner surface 82 of the top wall of the conduit 34 so that there is no shearing action on stringy products. The valve 30 also includes motor 118 (FIG. 3) that is connected to the drive shaft 90 to cause the pivotal movement of the drive shaft 90. Preferably, and as shown generally in FIG. 1, the motor 118 is mounted within a housing 119 that is connected to the outer surface 86 of the conduit bottom wall 74. As shown in FIGS. 3 and 4, the motor 118 includes an output shaft 120. A crank 128 is mounted on the shaft 120.

The valve 30 also includes a pin 132 depending from the outer surface 86 of the bottom wall 74 of the conduit 34. A sprocket 136 is pivotally mounted on the pin 132. The sprocket 136 has a diameter twice that of the sprocket 98. The crank 128 is drivingly connected to the sprocket 136 by a connecting rod 140, which is pivotally connected to both the crank 128 and the sprocket 136. The sprocket 136 is drivingly connected to the sprocket 98 by a roller chain 144. Rotation of the output shaft 120 acts through the crank 128 and the connecting rod 140 to cause reciprocating pivotal movement of the sprocket 136 through a range of 120°. This reciprocating movement of the sprocket 136 acts through the roller chain 144 to cause reciprocating pivotal movement of the sprocket 98, the drive shaft 90 and the packer blade 102 through a range of 240°. This drive arrangement is relatively inexpensive and allows a great deal of flexibility in location of the motor 118. The motor 118 can have a relatively slow speed, because the packer blade 102 preferably cycles about thirty times per minute. Alternative drive arrangements could include air or hydraulic cylinders or gears.

The valve 30 also includes (see FIGS. 2 and 3) a discharge resistor 164 mounted in the conduit 34. The discharge resistor 164 resists the flow of product through the conduit 34 toward the outlet 42 in order to cause substantially or functionally uniform compression of the product between the packer blade 102 and the discharge resistor 164. In other words, the plug of product between the packer blade 102 and the resistor 164 does not have any weak spots that could allow air to break through the plug. The discharge resistor 164 includes a gate 172 pivotally connected to the top wall of the conduit 34 by hinge 174 so that the gate hangs down into the conduit 34, substantially blocking the flow of product through the conduit 34. Sufficient pressure exerted on the gate 172 by product flowing from the packer blade 102 toward the outlet 42 forces the gate 172 upward to allow the newly compressed product to flow through the outlet 42. If necessary, the gate 172 can be biased downwardly by a spring. As an alternative to the hinged gate 172, other types of discharge resistors can be used such as, for example, a variable orifice discharge valve (not shown).

The valve 30 also includes a back-flow dam 176 (FIG. 3) to resist the flow of product through the conduit 34 in a direction from the discharge resistor 164 toward the packer blade 102. As shown particularly in FIG. 3, the back-flow dam 176 includes a stepped portion formed in the conduit 34 so that the portion of the conduit 34 downstream of the back-flow dam 176 has a greater cross-sectional area than the portion of the conduit 34 upstream of the back-flow dam 176. The stepped portion provides a downstream face 184 and an edge 188 between the face 184 and the inner surface 82. The face 184 opposes the discharge resistor 164. The face 184 and edge 188 engage the product plug to resist flow of the plug from the discharge resistor 164 toward the packer blade 102.

In operation, product enters the cyclone separator 14 inter-mixed with the air. The product separates from the air and falls to the bottom of the cyclone separator 14 to exit via the bottom outlet 26. The product enters the valve 30 through the upwardly opening inlet 38 which is connected to the bottom outlet 26. The product falls into the packing chamber 89 and into the stroke path of the packer blade 102. When the motor 118 driving the packer blade 102 is turned on, the packer blade 102 pivots (from the position of the packer blade shown in FIG. 2) in a first direction 120°, then reverses and pivots 240°, then reverses again and pivots 240° and so on. As the packer blade 102 oscillates through the stroke path, the product is moved continuously past the drive shaft 90 and through the conduit 34 toward the outlet 42. As mentioned above, the packer blade 102 preferably cycles about thirty times per minute. Higher speeds could prevent the free flow of material into the packing chamber 89 and cause stoppages at the inlet 38.

It is important to note that the back-flow dam does not impede in any way the forward or downstream flow of product through the conduit because the product plug does not impinge upon the face 184 or the edge 188 during forward flow.

While normally the packer blade 102 oscillates continuously, the valve 30 could also be automatically controlled by placing a sensor in the inlet 38 of the conduit 34. The sensor would automatically initiate oscillation of the packer blade 102 in response to the presence of product in the inlet 38.

As the conduit 34 fills with the product, a plug of product is formed in the conduit 34. The plug eventually impinges upon the gate 172 of the discharger resistor. The gate 172 resists the flow of product until the plug is sufficiently compressed to force the gate 172 upwardly allowing the plug to pass by the gate 172 and through the remainder of the conduit 34 to the outlet 42. The substantially uniformly compressed product plug passes through the outlet 42 into the baler feed hopper 50 or other receptacle adapted to receive the product from the oscillating blade valve 30.

Between alternate strokes of the packer blade 102 or when the valve 30 is turned off, the compressed product tends to expand in a natural effort to relieve the pressure of the compressed plug in the conduit 34. Because of the presence of the discharge resistor 164, the product cannot expand toward the outlet 42. Instead, the product plug tends to expand by moving in a direction toward the packer blade 102. This causes the product plug to contact the downstream face 184 and edge 188 of the back-flow dam 176. This contact substantially prevents further expansion, i.e., back-flow, of the plug toward the packer blade 102.

Figure 5:
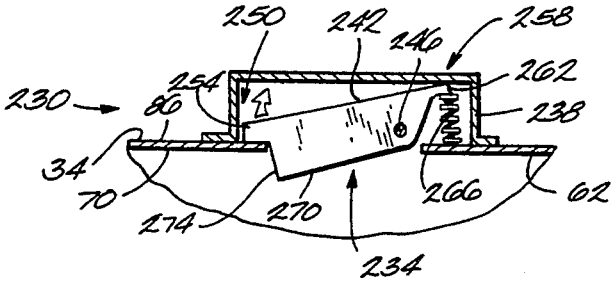
FIG. 5 is a partial cross-sectional view of an alternative embodiment of the invention.

FIG. 5 partially illustrates an apparatus 230 that is an alternative embodiment of the invention. The apparatus 230 is similar to the apparatus 30, and like parts will be identified using like reference numerals. Instead of a back-flow dam, a number of retainer dog assemblies 234 (only one of which is shown) are mounted in the conduit 34 to resist the flow of produce from the discharge resistor 164 toward the packer blade 102. The retainer dog assembly 234 includes a housing 238 mounted on the outer surface 86 of any of the conduit walls 70, 74 or 78. For the sake of example, the retainer dog assembly 234 is illustrated in FIG. 5 as being mounted on the top wall 70. A retainer dog 242 is mounted in the housing 238 and is pivotally supported by a pivot pin 246 so as to allow the retainer dog 242 to extend through the wall 70 of the conduit 34 and into the passage 62 defined by the conduit 34.

The retainer dog 242 includes a first end 250 having a tab 254 and a second end 258 having a latch arm 262. The ends 250 and 258 are opposite relative to the pivot pin 246. A spring 266 is mounted in the housing 238 between the outer surface 86 of the conduit wall and the latch arm 262. The force of the spring 266 on the latch arm 262 forces the retainer dog to an inner position in which the tab 254 contacts the outer surface 86 of the conduit wall. In this position, the retainer dog 242 defines an upstream surface 270 and a downstream surface 274, both of which are in the conduit 34. It is important that the retainer dogs 242 are mounted in the conduit 34 outside of the stroke path of the packer blade 102 so as not to interfere with movement of the packer blade 102.

The retainer dogs 234 do not significantly impede the forward flow of product through the conduit because the force of the product plug on the upstream surface 270 of the retainer dog 242 forces the retainer dog 242 against the force of the spring and out of the conduit passage 62.

Various features of the invention are set forth in the following claims.

I claim:

1. An apparatus for providing an air seal for a device discharging a compressible product, said apparatus comprising:

a generally horizontal conduit having an upwardly opening inlet and an outlet spaced from said inlet;

a packer blade mounted in said conduit for pivotal movement about a generally vertical axis, said packer blade having a stroke path extending beneath said inlet;

a motor connected to said packer blade to cause reciprocating pivotal movement of said packer blade about said axis so that product entering said conduit via said inlet is swept by said packer blade toward said outlet; and a discharge resistor which is located in said conduit between said packer blade and said outlet, which resists the flow of product through said conduit toward said outlet, and which permits compressed product to flow out of said conduit via said outlet;

such that said packer blade and said discharge resistor cause substantially uniform compression of the product between said packer blade and said discharge resistor so as to form a plug of product that substantially prevents air flow through said conduit in either direction.

2. An apparatus as set forth in claim 1 and further comprising a drive shaft pivotally mounted in said conduit adjacent said inlet for pivotal movement about said axis, and wherein said packer blade is mounted on said drive shaft for pivotal movement therewith.

3. An apparatus as set forth in claim 1 wherein said drive shaft is mounted in said conduit directly beneath said inlet and includes a lower end, and wherein said motor is drivingly connected to said lower end of said drive shaft.

4. An apparatus as set forth in claim 1 and further comprising a back-flow dam between said packer blade and said outlet for substantially preventing the flow of product through said conduit in a direction from said outlet toward said packer blade, said back-flow dam including a stepped portion formed in said conduit such that the portion of said conduit downstream of said back-flow dam has a greater cross-sectional area than the portion of said conduit upstream of said back-flow dam.

5. An apparatus as set forth in claim 1 and further comprising a spring-loaded retainer dog mounted in said conduit for substantially preventing the flow of product through said conduit in a direction from said outlet toward said packer blade.

6. An apparatus as set forth in claim 1 wherein said conduit has a longitudinal axis, and wherein said stroke path extends from between 180° and 270° about said axis and is bisected by a vertical plane including said axis.

7. An apparatus as set forth in claim 6 wherein said stroke path extends approximately 240° about said axis.

8. An apparatus as set forth in claim 1 wherein said discharge resistor includes a gate pivotally mounted in said conduit so that said gate contacts product flowing through said conduit to resist the flow of product through said conduit.

9. A system for compacting a compressible product, said system comprising:

a cyclone separator having a downwardly opening outlet;

a generally horizontal conduit having an upwardly opening inlet connected to said separator outlet to receive product therefrom, said conduit also having an outlet spaced from said inlet;

a packer blade mounted in said conduit for pivotal movement about a generally vertical axis, said packer blade having a stroke path extending beneath said inlet;

a motor connected to said packer blade to cause reciprocating pivotal movement of said packer blade about said axis so that product entering said conduit via said inlet is swept by said packer blade toward said outlet; and a discharge resistor which is located in said conduit between said packer blade and said outlet, which resists the flow of product through said conduit toward said outlet, and which permits compressed product to flow out of said conduit via said outlet;

such that said packer blade and said discharge resistor cause functionally uniform compression of the product between said packer blade and said discharge resistor so as to form a plug of product that substantially prevents air flow through said conduit in either direction.

10. A system as set forth in claim 9 and further comprising a drive shaft pivotally mounted in said conduit adjacent said inlet for pivotal movement about said axis, and wherein said packer blade is mounted on said drive shaft for pivotal movement therewith.

11. A system as set forth in claim 10 wherein said drive shaft is mounted in said conduit directly beneath said inlet and includes a lower end, and wherein said motor is drivingly connected to said lower end of said drive shaft.

12. A system as set forth in claim 9 and further comprising a back-flow dam between said packer blade and said outlet for substantially preventing the flow of product through said conduit in a direction from said outlet toward said packer blade, said back-flow dam including a stepped portion formed in said conduit such that the portion of said conduit downstream of said back-flow dam has a greater cross-sectional area than the portion of said conduit upstream of said back-flow dam.

13. A system as set forth in claim 9 and further comprising a spring-loaded retainer dog mounted in said conduit for substantially preventing the flow of product through said conduit in a direction from said outlet toward said packer blade.

14. A system as set forth in claim 9 wherein said discharge resistor includes a gate pivotally mounted in said conduit so that said gate contacts product flowing through said conduit to resist the flow of product through said conduit.

15. A system as set forth in claim 9 wherein said conduit has a longitudinal axis, and wherein said stroke path extends from between 180° and 270° about said axis and is bisected by a vertical plane including said axis.

16. A system as set forth in claim 15 wherein said stroke path extends approximately 240° about said axis.

17. An apparatus for providing an air seal for a device discharging a compressible product, said apparatus comprising:

a generally horizontal conduit having a longitudinal axis, an upwardly opening inlet, and an outlet spaced from said inlet;

a drive shaft having a lower end and a generally vertical drive shaft axis, said drive shaft being mounted in said conduit directly beneath said inlet;

a motor connected to said lower end of said drive shaft to cause reciprocating pivotal movement of said drive shaft from between 180° and 270° about said axis;

a vertically extending packer blade mounted on said drive shaft for pivotal movement therewith so that product entering said conduit via said inlet is swept by said packer blade toward said outlet, said packer blade having a stroke path extending beneath said inlet, said stroke path being bisected by a generally vertical plane including said axis;

a discharge resistor including a gate pivotally mounted in said conduit between said packer blade and said outlet, said gate resisting the flow of product through said conduit toward said outlet so that said packer blade and said discharge resistor cause substantially uniform compression of the product between said packer blade and said discharge resistor, and said gate permitting compressed product to flow out of said conduit via said outlet; and a back-flow dam in said conduit between said packer blade and said outlet to resist the flow of product through said conduit in a direction from said outlet toward said packer blade.

18. An apparatus as set forth in claim 17 wherein said back-flow dam includes a stepped portion formed in said conduit such that the portion of said conduit downstream of said back-flow dam has a greater cross-sectional area than the portion of said conduit upstream of said back-flow dam.

19. An apparatus as set forth in claim 17 wherein said drive shaft pivots approximately 240° about said axis.

* * * * *